US007350474B2

(12) United States Patent
Horiuchi

(10) Patent No.: US 7,350,474 B2
(45) Date of Patent: Apr. 1, 2008

(54) SAILING DEVICE

(76) Inventor: Kotaro Horiuchi, 19-11, Omachi 1-chome, Kamakura-shi, Kanagawa (JP) 248-0007

( * ) Notice: Subject to any disclaimer, the term of this patent is extended or adjusted under 35 U.S.C. 154(b) by 0 days.

(21) Appl. No.: 10/511,900

(22) PCT Filed: Apr. 18, 2003

(86) PCT No.: PCT/JP03/04942

§ 371 (c)(1),
(2), (4) Date: Nov. 16, 2005

(87) PCT Pub. No.: WO03/089293

PCT Pub. Date: Oct. 30, 2003

(65) Prior Publication Data

US 2006/0081165 A1 Apr. 20, 2006

(30) Foreign Application Priority Data

Apr. 20, 2002 (JP) ..... 2002-154741

(51) Int. Cl.
*B63H 9/04* (2006.01)

(52) U.S. Cl. ..... 114/102.11

(58) Field of Classification Search ..... 114/102.11
See application file for complete search history.

(56) References Cited

U.S. PATENT DOCUMENTS 4,047,492 A * 9/1977 Brown ..... 114/39.32
4,269,133 A * 5/1981 Brown ..... 114/102.11
4,382,417 A 5/1983 Talve
4,610,212 A 9/1986 Petrovich
4,848,258 A * 7/1989 Priebe ..... 114/39.31
5,826,530 A * 10/1998 Tuurna et al. ..... 114/102.11

FOREIGN PATENT DOCUMENTS

| | | |
|---|---|---|
| EP | 0015875 | 2/1980 |
| JP | 56-151074 | 3/1981 |
| JP | 58-211997 | 6/1982 |
| JP | 61-291291 | 6/1985 |
| JP | 63-502017 | 12/1985 |
| JP | 02-256590 | 11/1988 |
| WO | WO 87/03553 | 12/1985 |

* cited by examiner

*Primary Examiner*—Stephen Avila
(74) *Attorney, Agent, or Firm*—Reed Smith LLP; Stanley P. Fisher, Esq.; Juan Carlos A. Marquez, Esq.

(57) ABSTRACT

A sailing device suitable for a pleasure boat or the like of narrow width which is small in restoring force against traverse tilt. The sailing device is characterized by comprising a sail portion A composed of a backbone, a pair of left and right spars 3*a*, 3*b* extending obliquely backward from the fore end of the backbone 1, and a sail-cloth 8 attached at the fore edge thereof to the pair of left and right spars and at the aft end thereof to the aft end of the backbone 1, and a strut 4 extending downward from the fore end of the backbone 1. The lower end of the strut is directly mounted on the boat hull for rise and fall or indirectly attached to the boat hull by support of a user.

7 Claims, 10 Drawing Sheets

SAILING DEVICE

BACKGROUND OF THE INVENTION

1. Field of the Invention

The present invention relates to a sailing device suitable for use in a pleasure boat narrow in width such as a canoe, a kayak, a faltboat or the like, which is easily controlled without applying any inclination moment to the boat and capable of being unfolded and folded by simple operation of a user.

2. Prior Art

In small sailboats such as a dinghy equipped with a mast fixedly mounted to the hull, the boat tends to be fallen down by an inclination moment acting thereon when received a side wind. In such an instance, the user leans windward out of the hull for balance against the inclination moment. In contrast with such sailboats, a pleasure boat narrow in width such as a canoe, a kayak, a faltboat or the like is weak against a side wind since a restoring force against traverse tilt is very small. Accordingly, as a large sail may not be set on the boat, a small sail such as a wrapping cloth is set on the boat perpendicularly to a direction of travel for sailing in a tailwind. To avoid such a problem caused by an inclination moment, proposed in Japanese Patent Laid-open Publication No. 8-168550 is a sailing device such as a kite lifted with a single string. The sailing device comprises a sail which is operated by means of a plurality of control lines connected thereto.

Problem to be Solved:

In use of the sailing device proposed in Japanese Patent Laid-open Publication 8-168550, there will occur a difficulty in operation of the plural control lines. As the sail is indirectly operated through the plural control lines, it is difficult to cope with sudden change of a wind direction, and it is unable to rise the sail in a gentle wind. In addition, it is not easy to sail near the adverse wind, and it takes a time for a user to fold the sail on the boat. A primary object,of the present invention is to solve the foregoing problems.

Means for Solution of the Problem and Useful Effects Thereof:

According to the present invention, the object is accomplished by providing a sailing device suitable for use in a pleasure boat, which comprises a sail portion composed of a backbone, a pair of left and right spars extending obliquely backward from the fore end of the backbone and a sail-cloth attached at the fore edge thereof to the pair of left and right spars and at the aft end thereof to the aft end of the backbone, and a strut extending downward from the fore end of the backbone, the lower end of the strut being directly mounted on the boat hull for rise and fall or indirectly attached to the boat hull by support of a user. In use of the sailing device, an inclination moment applied to the boat hull becomes small even when received a side wind. Accordingly, a possibility of overturning would become extremely small even if the sail portion was enlarged. As the strut is supported by the user's hands in use of the sailing device, the sail portion can be operated by the user in a stable condition even in a gentle wind. Additionally, as the sail portion is directly operated by the user, it is able to promptly cope with sudden change of the wind direction.

In the sailing device, it is preferable that left and right wing sections of the sail portion each are provided with a dihedral angle to enhance directional stability and controllability of the sail portion against the wind. In a practical embodiment of the sailing device according to the present invention, it is preferable that the left and right spars are connected at their one ends to the fore end of the backbone for tilt movement, a slider is mounted on an intermediate portion of the backbone for slide movement in a longitudinal direction of the backbone, left and right rods are pivoted at their one ends to each intermediate portion of the spars and at their other ends to the slider, and a lower rod is pivoted at its one end to an intermediate portion of the strut and at its other end to the slider, wherein the slider is moveable in the longitudinal direction of said backbone to extend the spars obliquely backward from the fore end of the backbone and to fold the spars along the backbone, the slider being engageable with a stopper hook fixed to the fore portion of the backbone when the strut is unfolded downward from the fore end of the backbone and is folded along said backbone. With such arrangement as described above, the sailing device can be easily folded when the wind has fallen or grown stronger.

DESCRIPTION OF THE PREFERRED EMBODIMENTS

Figure 1:
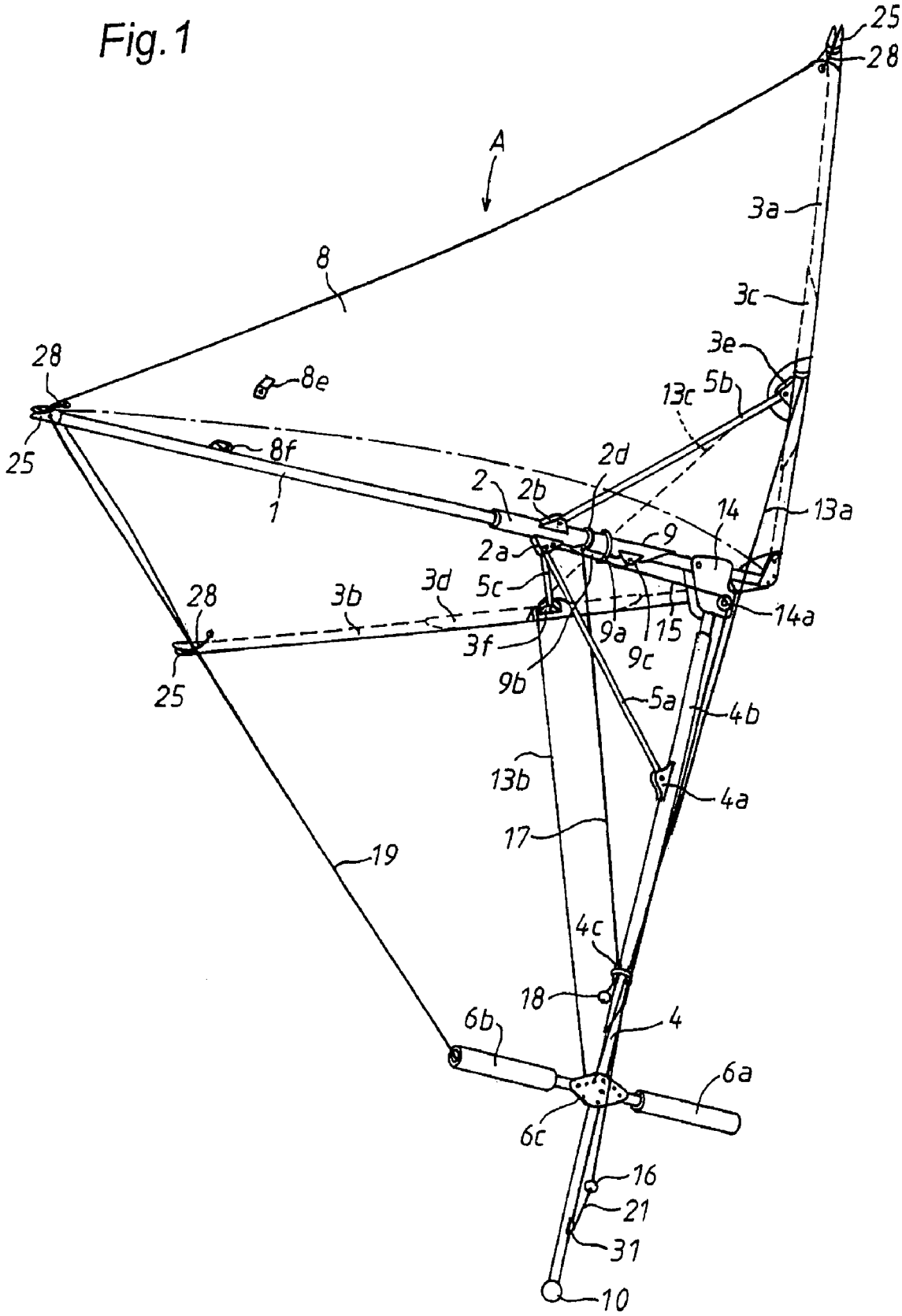
FIG. 1 is a perspective view illustrating the whole construction of a first embodiment of the present invention.

Hereinafter, a sailing device according to a first embodiment of the present invention will be described with reference to FIGS. 1~10. As shown in FIG. 1, the sailing device comprises a sail portion A composed of a backbone 1, a pair of left and right spars 3*a*, 3*b* extending obliquely backward from the fore end of backbone 1, and a sail cloth 8 attached at the fore edge thereof to the pair of left and right spars and at the aft end thereof to the aft end of backbone 1, and a strut 4 extending downward from the fore end of backbone 1. The sail portion A has left- and right-hand wing sections applied with a dihedral angle. In a condition where the backbone 1 is seen from its aft side toward its fore end, a wing section located at the right side is defined as the right wing section, while a wing section located at the left side is defined as the left wing section. In the sailing device, it is desirable that the backbone 1, spurs 3*a*, 3*b* and strut 4 each are in the form of a thin pipe made of light-weight high-strength material such as a high-strength and anti-corrosive aluminum alloy or carbon fiber reinforced plastic.

Figure 2:
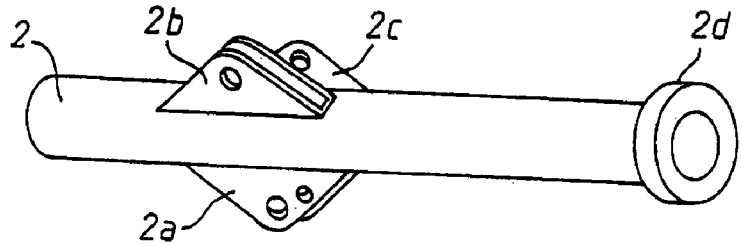
FIG. 2 is a perspective view of a slider.
Figure 3:
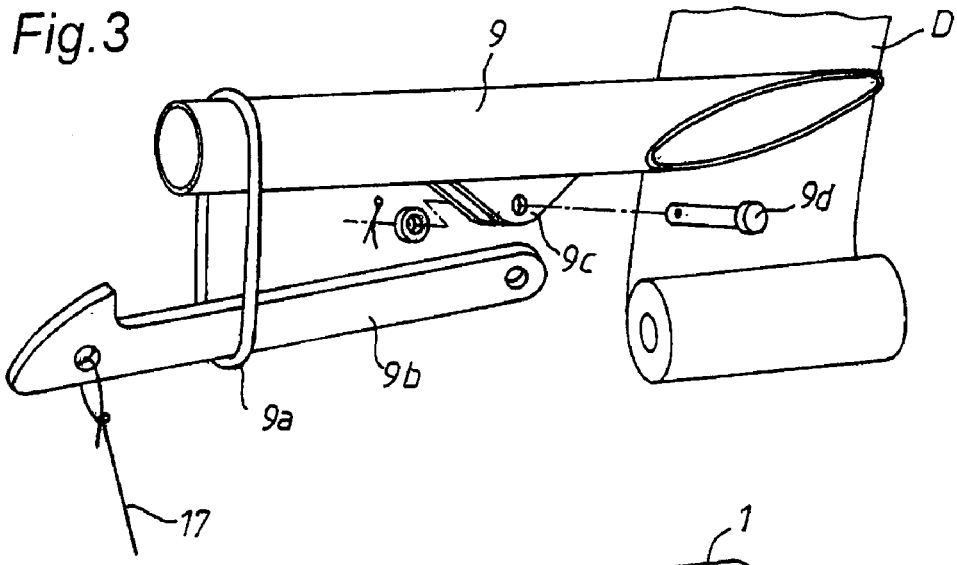
FIG. 3 is a perspective view of a stopper.

As shown in FIGS. 1 and 3, a tubular stopper 9 is fixed to the fore end of backbone 1. A stopper lug 9*c* is fixed to the lower side of stopper 9, and a stopper hook 9*b* is hingedly connected to the stopper lug 9*c* at its base by means of a pin 9*d*. A stopper rubber 9*a* is hooked with the stopper hook 9*b* and tubular stopper 9 so that the stopper hook 9*b* is pressed toward the backbone 1. The stopper 9 is fixed to the backbone 1 by means of an adhesive tape D. The stopper 9 may be fixed to the backbone 1 by means of a bolt and a nut through a washer or a fastening fixture. The stopper lug 9*c* may be directly provided on the backbone 1. As shown in FIG. 2, the aft portion of backbone 1 is inserted into a cylindrical slider 2 which is provided at its periphery with lugs 2*a*, 2*b*, 2*c* fixed thereto and at its fore end with a flange 2*d* fixed thereto.

Figure 6:
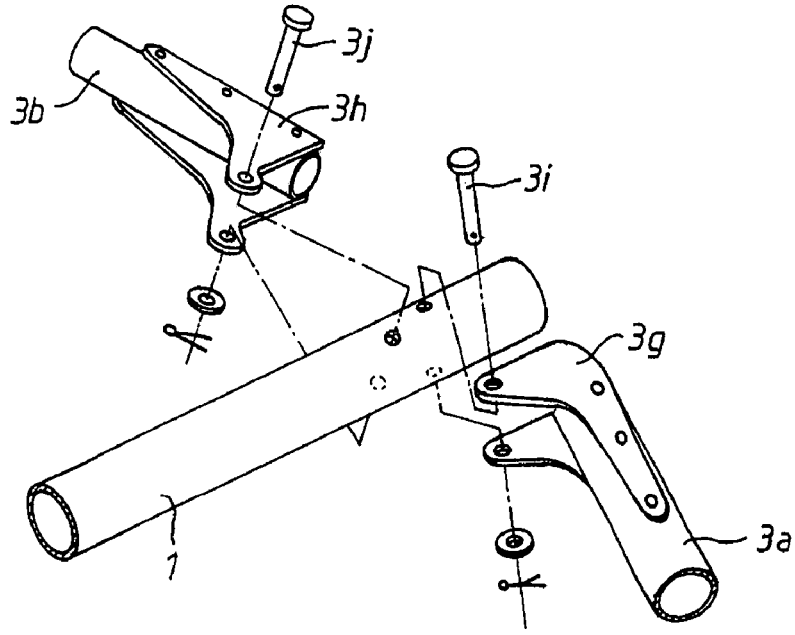
FIG. 6 is a perspective view illustrating a pivotal connection of a pair of left and right spurs to the backbone.

As shown in FIGS. 1 and 6, the spars 3*a*, 3*b* each are provided at their one ends with hinge brackets 3*g*, 3*h* fixed thereto and are hingedly connected at their one ends to the fore end portion of backbone 1 by means of pins 3*i*, 3*j* inserted into respective holes of the hinge brackets 3*g*, 3*h* aligned with corresponding holes of the fore end portion of backbone 1 and fixed in position by means of split pins and washers. With the hinge brackets 3*g*, 3*h*, the spars 3*a*, 3*b* are hinged to be movable between a position extending obliquely backward from the fore end of backbone 1 and a position folded along the backbone 1.

Figure 7:
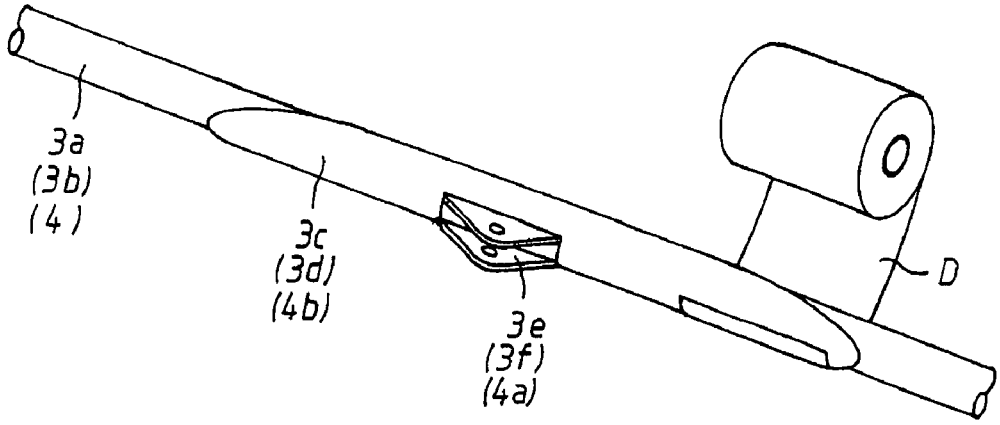
FIG. 7 is a perspective view illustrating an attachment method of a sleeve to the spars and a strut.

As shown in FIG. 7, sleeves 3*c*, 3*d* coupled with the spars 3*a*, 3*b* are provided with lugs 3*e*, 3*f* fixed thereto respectively. Left and right rods 5*b*, 5*c* are hingedly connected at their one ends to the lugs 2*a*, 2*b* of slider 2 and at their other ends to the lugs 3*e*, 3*f* of spurs 3*a*, 3*b* respectively. The lugs 3*e* and 3*f* are connected by means of a cable or rope 13*c* which cooperates with left and right tension ropes 13*a*, 13*b* to maintain the dihedral angle of left and right spars 3*a*, 3*b*. The left and right sleeves 3*c*, 3*d* are useful as reinforcement of the spars 3*a*, 3*b* at a portion applied with a maximum force. As the lugs 3*e*, 3*f* are moved by displacement of the sleeves 3*c*, 3*d*, the mounting positions of left and right rods 5*b*, 5*c* can be adjusted in necessity. Although in this embodiment, the left and right sleeves 3*c*, 3*d* are obliquely cut at their opposite ends and attached to the spars 3*a*, 3*b* by means of an adhesive tape D wound there on, the sleeves 3*c*, 3*d* may be fixed to the spars 3*a*, 3*b* by means of bolts passed therethrough and fastened by nuts.

Figure 8:
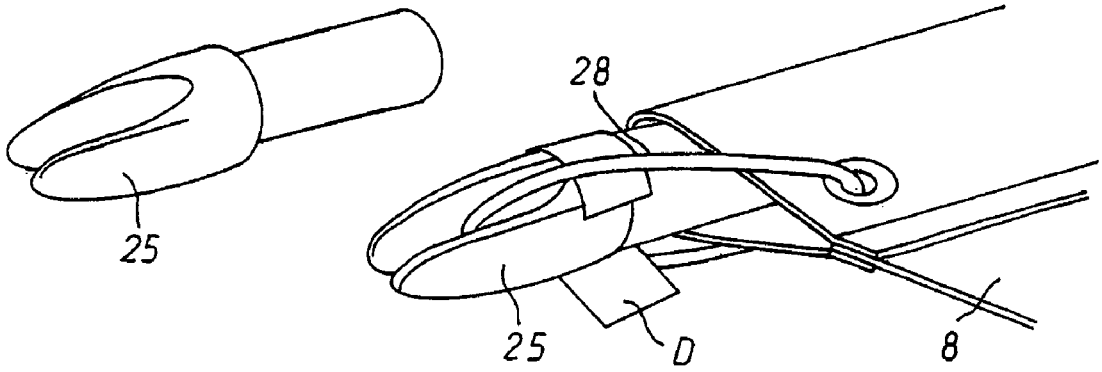
FIG. 8 is a perspective view of an end-piece.

The left and right spurs 3*a*, 3*b* are inserted into sheath portions formed at the front edges of sail cloth 8. As shown in FIG. 8, an end-piece 25 is coupled with each distal end of the left and right spurs 3*a*, 3*b* and fixed in position by means of an adhesive tape D. The distal ends of front edges of sail cloth 8 are hooked to a bifurcated end of the end-piece 25 by means of an end-rubber 28. Similarly, the aft end of sail cloth 8 is hooked to a bifurcated end of an end-piece 25 fixedly coupled with the aft end of backbone 1 by means of an end-rubber 28. Thus, the sail cloth 8 is applied with an appropriate tension force in longitudinal and lateral directions.

Figure 10:
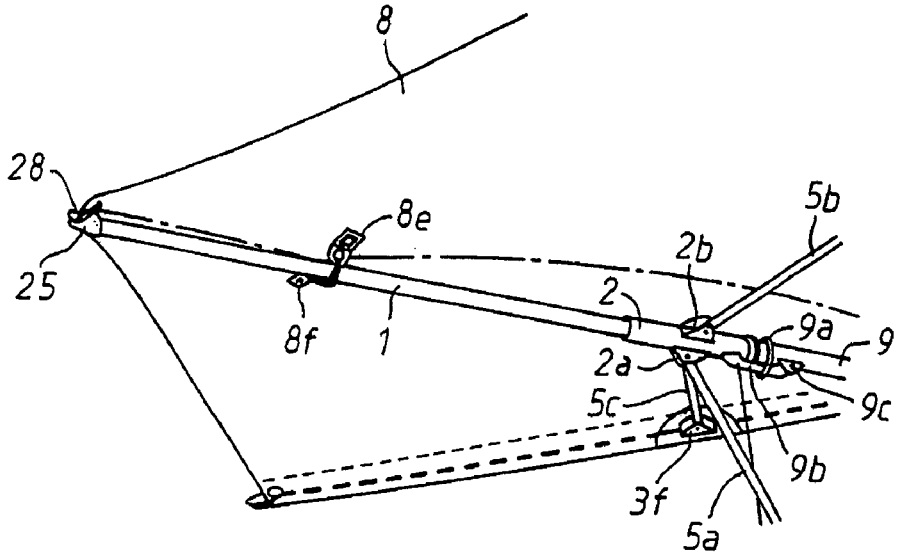
FIG. 10 is a perspective view of an aft portion of a sail cloth fastened to the backbone.

As shown in FIGS. 1 and 10, the sail cloth 8 is provided at its central aft portion with ear tabs 8*e*, 8*f* which are connected to the backbone 1 by means of a rope in accordance with magnitude of wind to enhance longitudinal stability of the sailing device and to adjust a propulsive force. In stead of the ear tabs 8*e*, 8*f*, the sail cloth 8 may be directly connected to the backbone 1 by means of a rope. As is understood from the above description, the left and right spars 3*a*, 3*b* of the sail portion A are provided with a dihedral angle so that the left and right wing sections of the sail portion A are applied with a dihedral angle.

Figure 4:
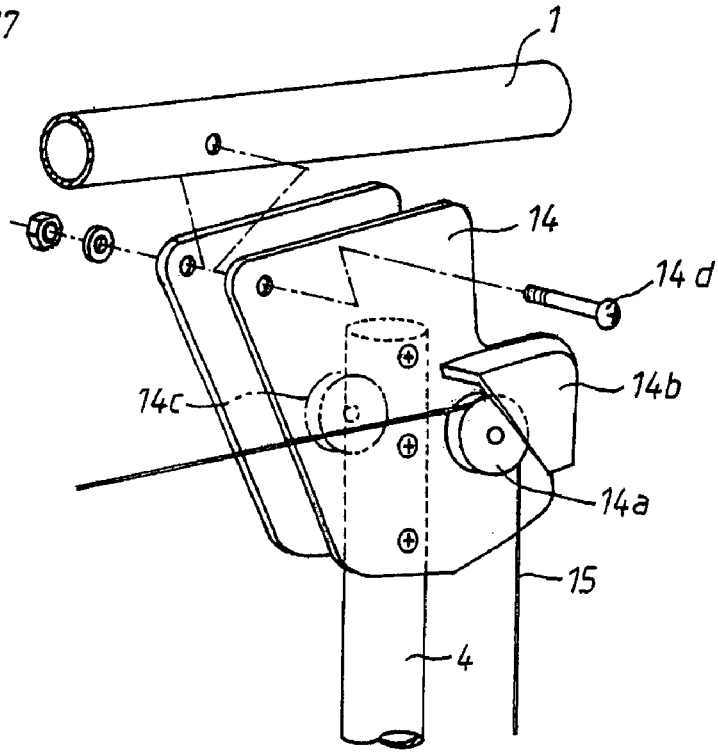
FIG. 4 is a perspective view illustrating a pivotal connection of a head block and a backbone.

As shown in FIG. 4, the strut 4 for support of the sail portion A is provided at its upper end with a head block 14 bolted thereon. The head block 14 is connected to the backbone 1 by means of a bolt 14*d* inserted into holes of the head block 14 aligned with corresponding a hole of backbone 1 at a backside of the mounting holes of the spurs 3*a*, 3*b* and fastened by a nut through a washer. With such connection of the head block 14, the strut 4 is hingedly connected to the backbone 1 to be movable between a position extending downward from the fore end of backbone 1 and a position folded along the backbone 1.

As shown in FIG. 1, a sleeve 4*b* coupled with an intermediate portion of strut 4 is provided with a lug 4*a* which is hingedly connected to one end of the lower rod 5*a* hinged at its other end to the lug 2*a* of slider 2 described above. The sleeve 4*b* is useful as reinforcement of the strut 4 at a portion applied with a maximum force. As the lug 4*a* is moved by displacement of the sleeve 4*b*, the hinged portion of lower rod 5*a* can be adjusted in necessity for slight adjustment of a folding position. Although in this embodiment, the sleeve 4*b* is obliquely cut at their opposite ends as well as the left and right sleeves 3*c*, 3*d* and attached to the strut 4 by means of an adhesive tape D wound there on, the sleeve 4 may be fixed to the strut 4 by means of bolts passed therethrough and fastened by nuts.

Figure 5:
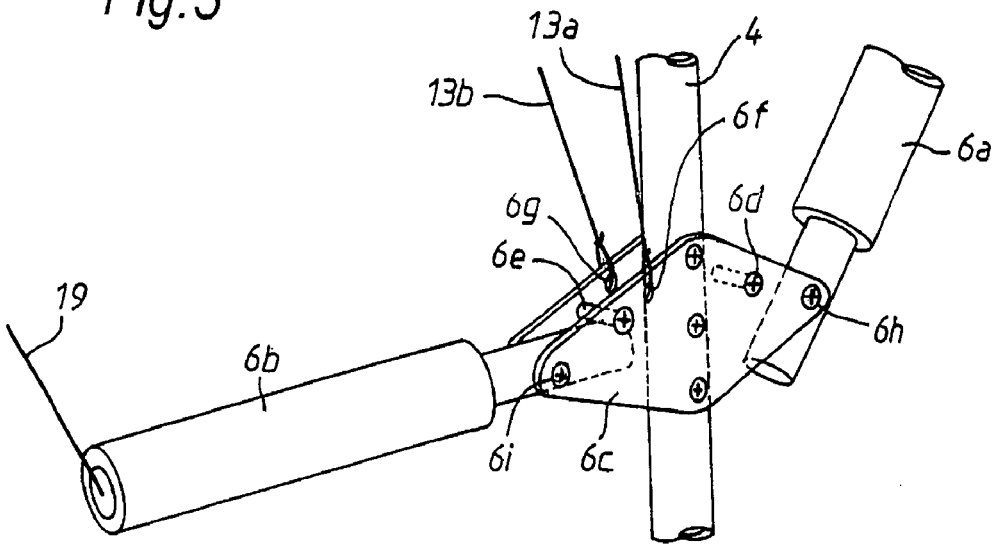
FIG. 5 is a perspective view of a handle.

As shown in FIG. 5, a handle bracket 6*c* composed of diamond-shaped aluminum plates is fixed to the strut 4 in such a manner as to sandwich a lower portion of the strut 4 at a position suitable for operation of a user. Front and rear handles 6*a*, 6*b* are hinged to the opposite ends of handle bracket 6*c* by means of bolts 6*h*, 6*i*. Stopper bolts 6*d*, 6*e* are fastened to upper front and rear portions of the handle bracket 6*c* to restrict downward movement of the handles 6*a*, 6*b* by abutment with them when they are folded downwardly and to permit upward movement of the handles 6*a*, 6*b* when they are folded upwardly. Thus, the handles 6*a*, 6*b* each are retained at a lateral position perpendicular to the strut 4 and at a position folded upwardly along the strut 4. Left and right tension ropes 13*a*, 13*b* are fastened at their one ends to holes 6*f*, 6*g* of handle bracket 6*c* and at their other ends to the lugs 3*e*, 3*f* of spurs 3*a*, 3*b*. The tension ropes 13*a*, 13*b* cooperate with the upper tension rope 13*c* to stabilize and reinforce the sailing device in construction. A tail rope 19 is fastened at its one end to the distal end of rear handle 6*b* and at its other end to an end-piece 25 fixedly coupled with the aft end of backbone 1 to prevent the backbone 1 of sail portion A from bending caused by wind. The tail rope 19 may be fastened at its one end to a lower portion of strut 4.

Figure 9:
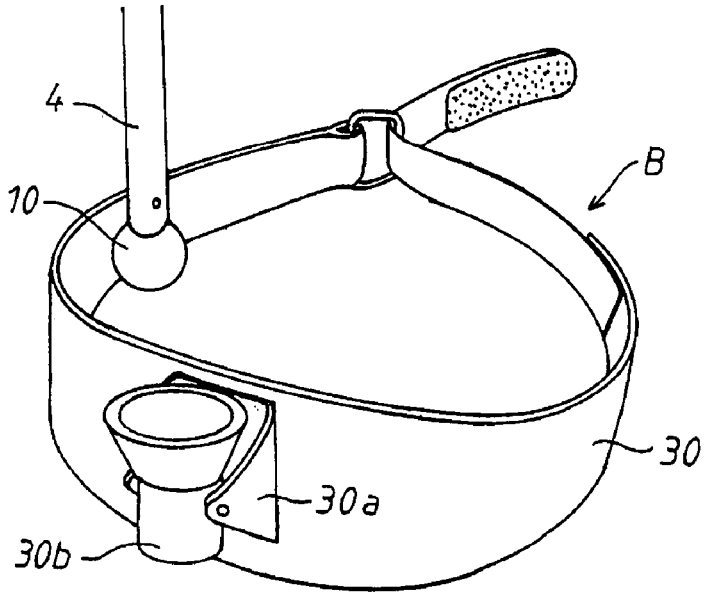
FIG. 9 is a perspective view of an adaptor.

In use of the sailing device, the lower end of strut 4 is attached to an adaptor B fastened to a user as shown in FIG. 9. The adaptor B includes a belt 30 for attachment with a user, a holder 30*a* fixed to the belt 30, and a socket 30*b* attached to the holder 30*a* for rotary movement about a lateral axis. A joint ball 10 is secured to the lower end of strut 4. In a condition where the joint ball 10 of strut 4 has been received by the socket 30*b*, both the handles 6*a*, 6*b* or either one of the handles are operated by the user for tilting the sail portion A and for rotary movement of the sail portion A about the axis of strut 4.

An unfolding rope 15 connected at its one end to the lug 2*a* of slider 2 is extended to an intermediate portion of strut 4 through a first guide pulley 14*a* mounted to a side face of the head block 14. The other end of unfolding rope 15 is extended downward through one of cylindrical rope guides 4*c* attached to the opposite sides of strut 4. A red ball 16 is connected to the other end of unfolding rope 15, and a rubber string 21 is connected to the red ball 16. The rubber string 21 is inserted into the strut 4 through an opening 13 formed in the lower portion of strut 4, extended out of the upper end of strut 4 and connected at its other end to the head block 14. The rubber string 21 is stretched with initial tension to lightly pull the red ball 16 downward. This serves to prevent the unfolding rope 15 from being caught in another when the sail portion A has been unfolded and to prevent the red ball 16 from being lost in sight. To prevent removal of the unfolding rope 15 in use of the sailing device, the first guide pulley 14*a* is enclosed with a cover 14*b* of sheet metal mounted to a side portion of the head block 14. The cover 14*b* may be replaced with a block of elastic material positioned for slight engagement with the outer periphery of guide pulley 14*a*. In the case that the lower end portion of unfolding string 15 in an extent is formed of fiber reinforced plastic of appropriate bending stiffness and that a joint portion of the unfolding string 15 with the fiber reinforced plastic is placed without extending downward from the rope guide 4*c* in an unfolded condition of the sail portion, it is able to prevent the unfolding string from being caught in another and to prevent the red ball 16 from being lost in sight. A release rope 17 is connected at its one end to the stopper hook 9*b* and extended downward through another rope guide 4*c*. A blue ball 18 is connected to the other end of release rope 17. The red and blue balls 16 and 18 may be provided in the form of a different color and shape if they are conspicuous and easy to grip.

Figure 11:
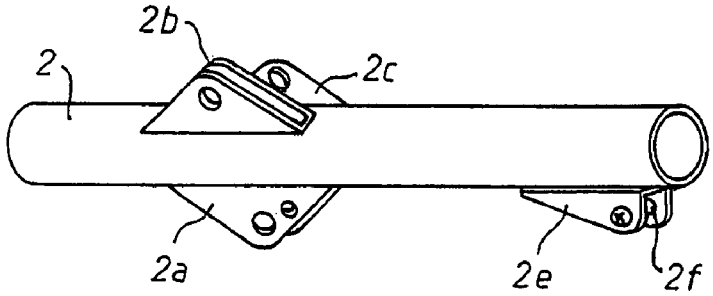
FIG. 11 is a perspective view of a modification of the slider.

As shown in FIG. 11, a lug 2*e* of U-shape in cross-section may be fixed to the front end of slider 2 in stead of the flange 2*d*. In such a case, the hook portion of stopper 9*b* can be engaged with the slider 2 by engagement with a bolt 2*f* fastened to the lug 2*e*.

Figure 12:
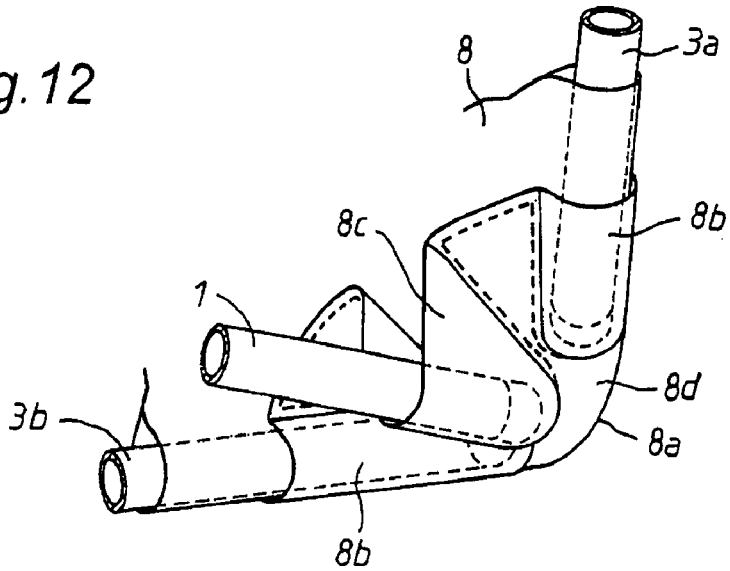
FIG. 12 is a perspective view of a top-piece shown obliquely from a lower side.

In the first embodiment, the spars 3*a*, 3*b* are hingedly connected to the fore end of backbone 1 by means of the hinge brackets 3*g*, 3*h* for tilt movement. Illustrated in FIG. 12 is a modification of the hinge connection of spurs 3*a*, 3*b*, wherein a top-piece 8*a* of sailcloth is sewed to the fore end of sail cloth 8 at a portion where respective fore ends of the backbone 1 and spars 3*a*, 3*b* are assembled. The top-piece 8*a* is composed of a pair of first sheath portions 8*b* formed to cover each sheath portion of the fore end of sail cloth 8 and a second sheath portion 8*c* opened backward between the first sheath portions 8*b*. The sheath portions 8*b*, 8*b* are sewed to a flat portion of sail cloth 8 at their side portions respectively in such a manner as to form openings for insertion of each fore end of the backbone 1 and spars 3*a*, 3*b* and to form a closed end for retaining each fore end of the backbone 1 and spars 3*a*, 3*b*. The backbone 1 and spars 3*a*, 3*b* are connected to each other at their fore ends inserted into the first and second sheath portions 8*b* and 8*c* of elastic top-piece 8*a* for tilt movement and retained in position by end rubbers 28 hooked to each end-piece 25 at their aft ends. With the top-piece 8*a*, the backbone 1 and spars 3*a*, 3*b* can be assembled in a simple manner.

The sailing device is preserved in a closed condition. When it is desired to use the sailing device, the user fastens the belt 30 of adaptor B, inserts the lower end joint ball 10 of strut 4 into the socket 30*b* of adaptor B, holds the handles 6*a*, 6*b* to retain the strut 4 in an approximately vertical position, and pulls down the unfolding rope 15 with the red ball 16 in a condition where the strut 4 is located at a windward side. With such operation, the slider 2 is pulled toward the stopper 9 at the fore portion of backbone 1, and the spars 3*a*, 3*b* and strut 4 are unfolded against the strut 4 by means of the three rods 5*a*, 5*b*, 5*c* in connection with the slider 2. When the slider 2 is engaged with the stopper 9, the stopper hook 9*b* is brought into engagement with the flange 2*d* of slider 2 to retain the spars 3*a*, 3*b* and strut 4 in the unfolded condition. In such a condition, the upper tension rope 13*c* connected to the intermediate portions of spurs 3*a* and 3*b* and the left and right tension ropes 13*a*, 13*b* connected to each intermediate portion of spars 3*a*, 3*b* and the handle bracket 6*c* are stretched in a triangular arrangement without any loose to firmly retain the spars 3*a*, 3*b* and strut 4 in their unfolded positions relative to the backbone 1. Thus, the left and right wing sections of sail portion A are retained at a predetermined dihedral angle.

Figure 18:
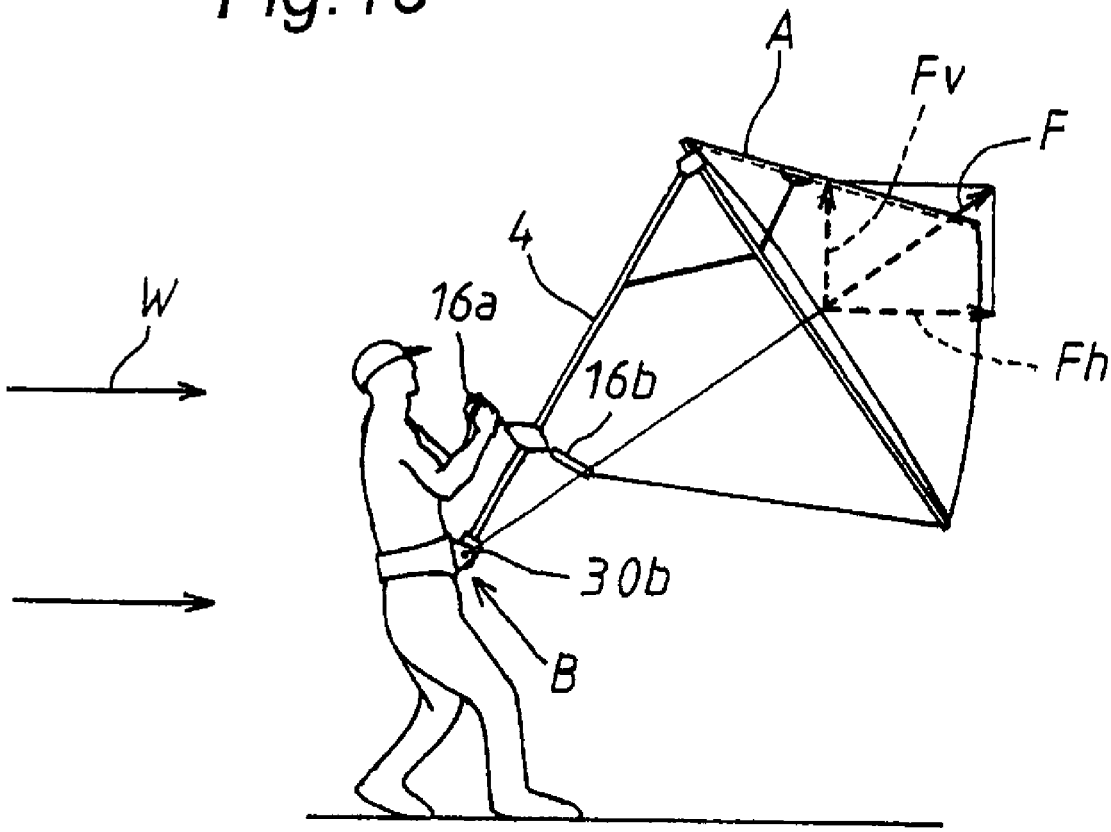
FIG. 18 is a side view illustrating a training condition with the sailing device on the ground.

In this embodiment, the sailing device can be supported by a small force as it rises above the user like a kite. As shown in FIG. 18, the sailing device is supported at the front of the user's body and carried by the user's hands gripped the handles 6*a*, 6*b* in a condition where the lower joint ball 10 of strut 4 has been received by the socket 30*b* of adaptor B fastened to the user's body. When received a tail wind as shown an arrow W, the sail portion A is down the wind, and the fore side of sailing device A is directed to the windward. In such a condition, a resultant force F of lift forces vertically acting on the left and right wing sections of the sail portion A acts obliquely upward on the center of sail portion A in width direction, and the sail portion A is pulled by a horizontal component Fh of the resultant force and lifted by a vertical component Fv of the resultant force F. The resultant force F is balanced with the weight of the sailing device in accordance with relative velocity of the wind to the sail portion A. When the angle of backbone 1 relative to the strut 4 is changed to adjust the position of the lower joint ball 10 of strut 4, the sailing device can be supported by the handles 6*a* and 6*b* with a small force. In such an instance, the horizontal component Fh is decreased by movement of the sail portion A toward the head side of the user and increased by downward movement of the sail portion A.

When the sail portion A is displaced leftward from the leeward at its aft end in a condition where the left and right wing sections of the sail portion A have been placed at the same height without lateral inclination, an angle of elevation to the wind increases at the left wing section of the sail portion A and decreases at the right wing section of the sail portion A. This results in an increase of the lift force at the left wing of the sail portion A and a decrease of the lift force at the right wing section of the sail portion A. In such an instance, the resultant force F of lift forces acting on the entirety of sail portion A is directed rightward. As a result, the aft end of sail portion A is pushed back to the leeward. Similarly, when the sail portion A is displaced rightward from the leeward at its aft end, the aft end of sail portion A is pushed back to the leeward. This is effective to enhance stability in the direction of the sailing device.

When the strut 4 is twisted with the handles 6*a*, 6*b* to incline the left wing section of sail portion A downward, the fore end of sail portion A is displaced leftward from the windward. In such an instance, the resultant force F acting on the entirety of sail portion A inclines leftward to cause a leftward horizontal component. The horizontal component causes a clockwise moment about the lower joint ball 10 of strut 4 in a plan view in the figure. As a result, the aft end of sail portion A is tilted leftward with the center at the joint ball 10. When the right wing section of sail portion A is inclined downward in a similar manner as described above, a counterclockwise moment will occur about the lower joint ball 10 of strut 4 in a plan view in the figure. As a result, the aft end of sail portion A is tilted rightward with the center at the joint ball 10. Such operation of the sailing device as described above can be trained on the ground as shown in FIG. 18.

In use of the sailing device on a boat, the angle of backbone 1 relative to the strut 4 is adjusted to 45°-75° (desirably, 60°), and each dihedral angle of left and right wings of sail portion A is adjusted to 15°-35° (desirably, 23°). With such adjustment of the angles, even when received an adverse wind obliquely from the front, it is able to sail the boat with the sail portion A the aft end of which is obliquely directed on the bow of the boat.

Figure 16:
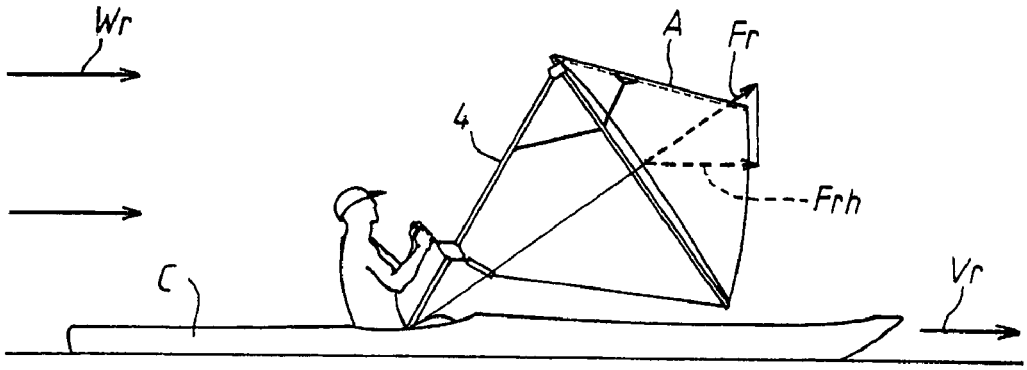
FIG. 16 is a side view illustrating a function of the sailing device according to the present invention in a tailwind.
Figure 17A:
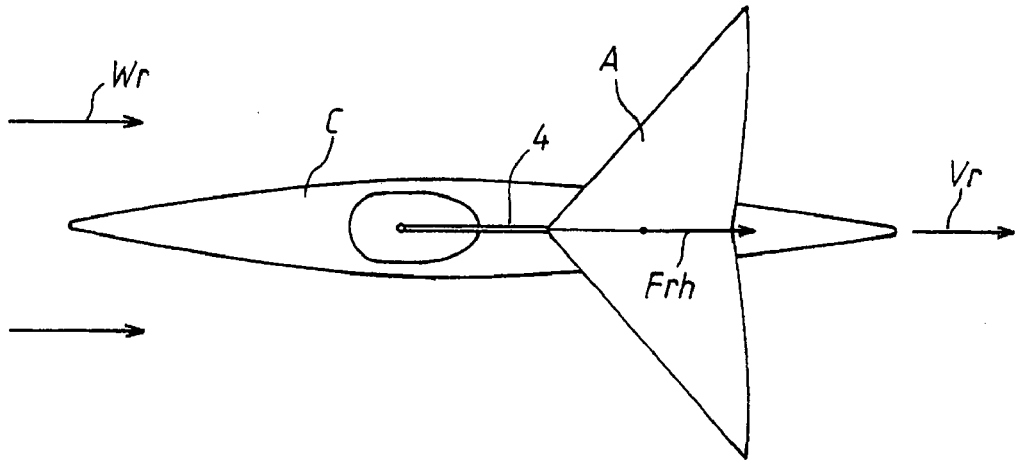
FIGS. 17(*a*), (*b*) and (*c*) are plan views illustrating a function of the sailing device according to the present invention in respective wind directions.
Figure 17B:
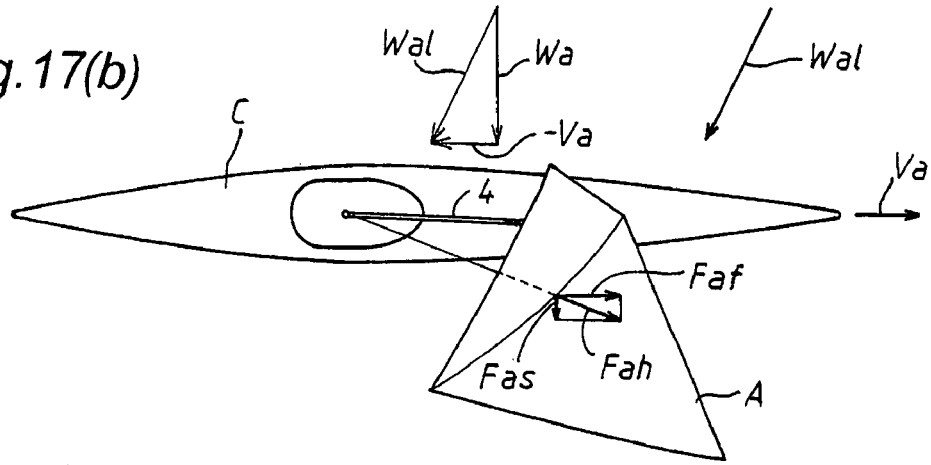
Figure 17C:
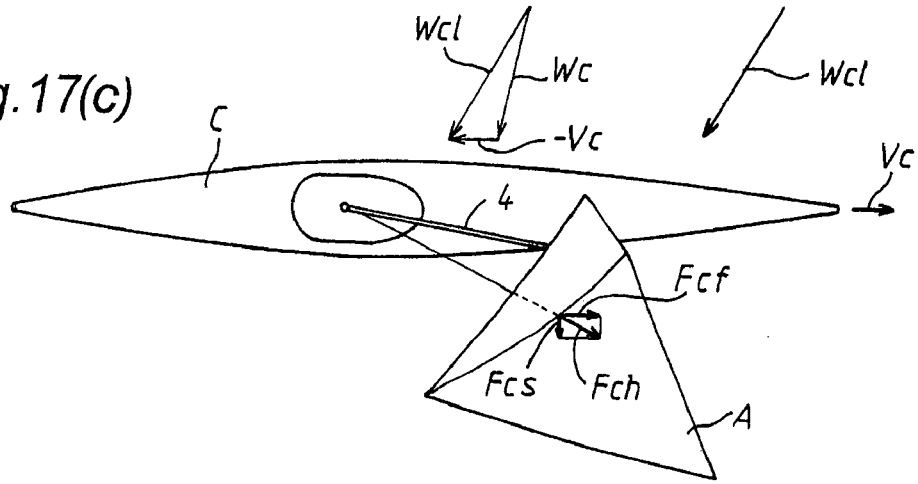

Hereinafter, sailing operations of a boat C with the sailing device will be described with reference to FIGS. 16 and 17. In use of the sailing device, a wind force acting on the sail portion A is transmitted to the boat through the lower join ball 10 received by the socket 30*b* of adaptor B fastened to the user's body. As the join ball 10 is rotatable on the socket 30*b*, only a resultant force acting on the sail portion A is transmitted to the adaptor B. The boat is equipped with a center board or a leeboard (not shown) for resisting to a lateral flow caused by a side-force.

When received a tail wind, the sailing device is used in such a manner that the sail portion A is retained without causing any lateral inclination. Assuming that the boat C is sailing before the wind at a speed Vr, the velocity of the wind acting on the sail portion A is defined by a difference between the velocity of the tail wind and the sailing speed Vr of the boat, and the resultant force Fr of lift forces vertically acting on the left and right wings of sail portion A acts obliquely upward on the central surface of sail portion A in a lateral direction. Thus, the boat C is sailed by a horizontal component Frh of the resultant force. When the sail portion A is tilted above the head of the user by operation of the handles 6*a*, 6*a* during sailing of the boat, the angle of elevation is decreased, and the horizontal component Frh is decreased in accordance with approach of the resultant force Fr to a vertical direction. When the sail portion A is tilted downward at its fore end, the angle of elevation is increased, and the horizontal component Frh is increased in accordance with approach of the resultant force to a horizontal direction. Thus, the sailing speed of the boat can be adjusted by such operation of the sailing device as described above.

When received a side wind in a condition where the sail portion A is retained without causing any lateral inclination and where the aft end of sail portion A is located leeward, the strut 4 is twisted in a counterclockwise direction by operation of the handles 6*a*, 6*b* so that the right wing of sail portion A is inclined downward to tilt the aft end portion of the sailing device about the socket 30*b* of adaptor B in a counterclockwise direction. With such operation, the strut 4 is approached to the sailing direction of the boat C as shown in FIG. 17(*b*). Assuming that the boat C is sailing at a speed Va in such a condition as described above, the wind to the sail portion A is changed by influence of the sailing speed as shown by an arrow Wal, and the horizontal component of the resultant force of lift forces vertically acting on left and right wings of the sail portion A becomes as shown by an arrow Fah and is transmitted to the socket 30*b* of adaptor B fastened to the user's body through the lower join ball 10 of the strut 4. Thus, the boat is sailed by a forward component Faf of the horizontal component Fah at the speed Va. In such an instance, the lateral flow of the boat caused by a lateral component Fas is prevented by the center board or leeboard (not shown), and the sailing speed Va of the boat can be controlled by operation of the handles 6*a*, 6*b* for adjustment of the sail portion A.

When received an adverse wind obliquely from the left front of the boat C as shown by an arrow Wc, the fore end of backbone 1 is approached to the sailing direction of the boat C more than that in the side wind described above. Assuming that the boat C is sailing at a speed Vc in such a condition as described above, the wind to the sail portion A changes in accordance with the sailing speed as shown by an arrow Wc1, and the horizontal component of the resultant force of lift forces vertically acting on left and right wings of the sail portion A becomes as shown by an arrow Fch. Thus, the boat C is sailed by the horizontal component Fch at the speed Vc. With such operation of the sailing device When received an adverse wind obliquely from the left front as shown by an arrow Wc, the use causes the fore end of backbone 1 to approach in the sailing direction of the boat more than that in the side wind described above. Assuming that the boat C is sailing at a speed Vc, the wind to the sail portion A is changed by influence of the sailing speed as shown by an arrow Wc1, and the horizontal component of the resultant force of lift forces vertically acting on the left and right wings of sail portion A becomes as shown by an arrow Fch. Thus, the boat C is sailed windward at the speed Vc by the horizontal component Fch across the adverse wind. In such an instance, the lateral flow of the boat caused by a lateral component Fcs is prevented by the center board or leeboard (not shown), and the sailing speed Vc of the boat can be controlled by operation of the handles 6*a*, 6*b* for adjustment of the sail portion A.

When it is desired to finish the sailing, the front handle 6*a* is directed windward to eliminate the lateral inclination of the sail portion A, and the fore end of sail portion A is directed just windward. In such a condition, the blue ball 18 is pulled to draw the release string downward thereby to disengage the stopper hook 9*b* from the front flange 2*d* of slider 2 against a resilient force of stopper rubber 9*a*. Thus, the left and right spars 3*a*, 3*b* are moved by tension of the sail cloth 8 toward their fold positions, and the slider 2 is retracted by the left and right rods 5*b*, 5*c* such that the strut 4 is moved to its fold portion. Subsequently, the handles 6*a*, 6*b* are folded upward along the strut 4, and the spars 3*a*, 3*b* and strut 4 are further approached to the backbone 1 so that the sailing device is folded in the form of a single pole. The folded sailing device is removed from the socket 30*b* of adaptor B and fallen on the front deck of the boat C to avoid disturbance in use of paddles or oars for rowing the boat and to lower the gravity of the boat.

In this kind of sailing devices, desired operations may not effected due to deterioration of stability of the sail portion A in a fore-and-aft direction when received a high wind. This is caused by decrease of an angle of elevation to the high wind applied to the sail portion A. When the angle of elevation to the wind decreases, each lift force acting on the wings of sail portion A displaces to aft sides of the wings, resulting in further decrease of the angle of elevation finally to a negative angle. Such a problem can be solved by fastening the aft portion of sail cloth 8 to the backbone 1 by means of strings passed through ear pieces 8*e*, 8*f* fixed to the aft portion of sail cloth 8 as shown in FIG. 10. In the case that the aft portion of sail cloth 8 is fastened to the backbone 1, the sail cloth 8 is filled with the wind at the fore side of ear pieces 8*e*, 8*f*, while the aft portion of sail cloth 8 is retained along the backbone 1 even when received the high wind. Accordingly, the displacement of the acting position of lift forces toward the aft side becomes small. This is effective to ensure the normal function of the sailing device. Even when the angle of elevation tends to decrease to a negative angle, the wind applied to an upper surface of the aft portion of sail cloth 8 along the backbone 1 acts to push back the sail portion A to a normal condition. This is effective to enhance the stability of the sailing device in the fore-and-aft direction in a high wind.

In a condition where the aft portion of sail cloth 8 is fastened to the backbone 1 by means of the string, a propulsive force of the sail portion A decreases due to decrease of lift forces acting on the wings of sail portion A. This results in decrease of the sailing speed of the boat C. Accordingly, when received a gentle wind, the sailing device is used in a condition where the string fastening the aft portion of sail cloth 8 to the backbone 1 was released.

Hereinafter, a second embodiment of the present invention will be described with reference to FIGS. 13 and 15. In this embodiment, only the lower end portion of strut 4 and the aft section of sail portion A are different from those in the first embodiment. In the second embodiment, the joint ball 10*a* fixed to the lower end of strut 4 in the first embodiment is replaced with a universal joint foldable in whole directions using a rubber element. A plug body 11 of U-shape in cross-section is mounted to the universal joint 10*a* for rotary movement about a vertical axis. A U-letter shaped leaf spring 11*b* coupled with the plug body 11 has a projection 11*a* caulked thereto. The projection 11*a* of leaf spring 11*b* is engaged with a corresponding hole in one side of plug body 11 in such a manner that the tip of projection 11*a* stands out of the corresponding hole to be pushed inward against the resilient force of leaf spring 11*b*. A tubular socket 12 of square in cross-section is mounted on the boat hull to receive the plug body 11. When the plug body 11 is inserted into the socket 12, the sailing device is firmly mounted on the boat hull by engagement of the projection 11*a* of leaf spring 10*b* with the corresponding hole of plug body 11. When the projection 11*a* is pushed inward, the sailing device can be easily removed from the socket 12.

Figure 13:
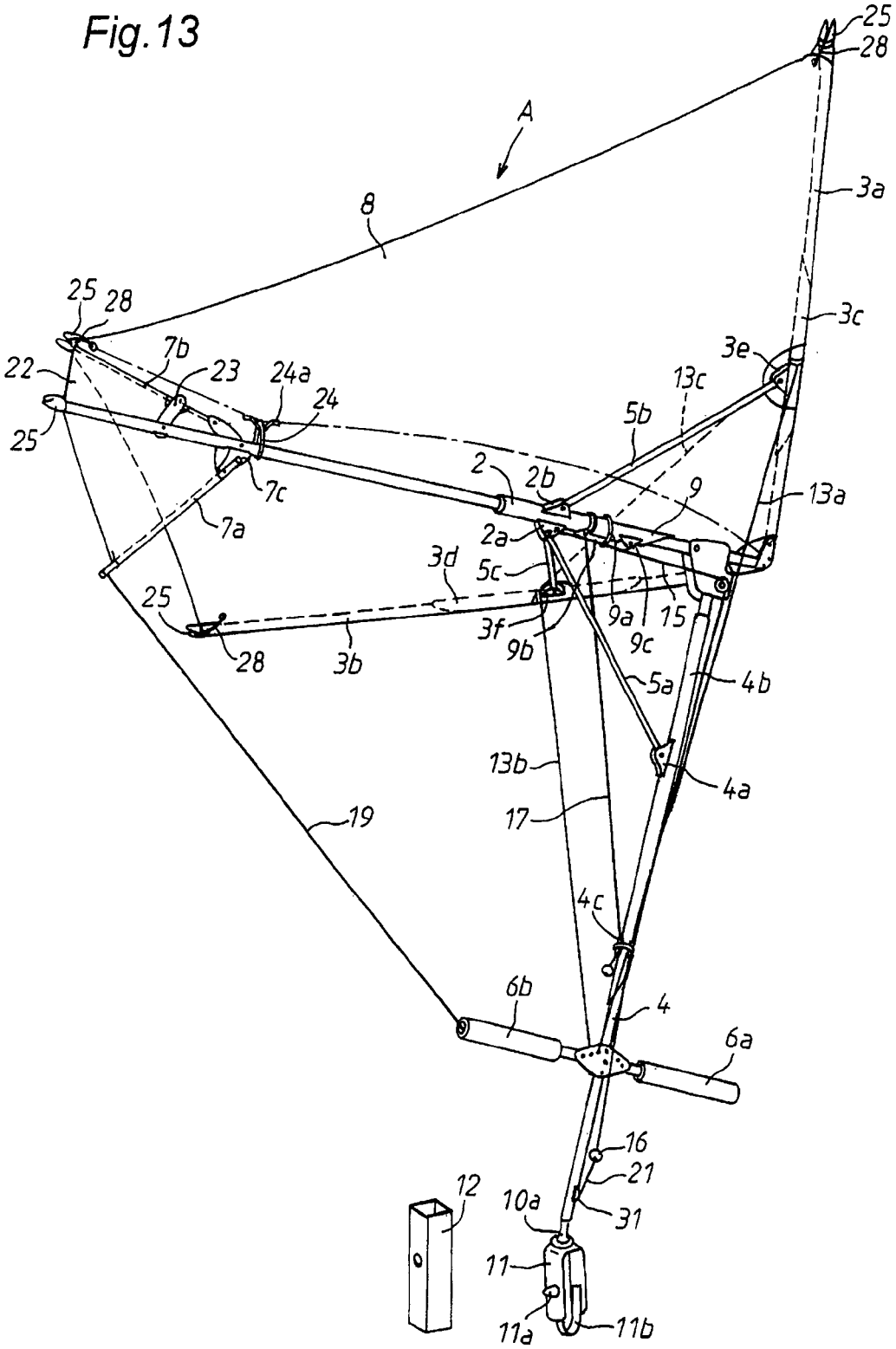
FIG. 13 is a perspective view illustrating the whole construction of a second embodiment of the present invention.
Figure 14:
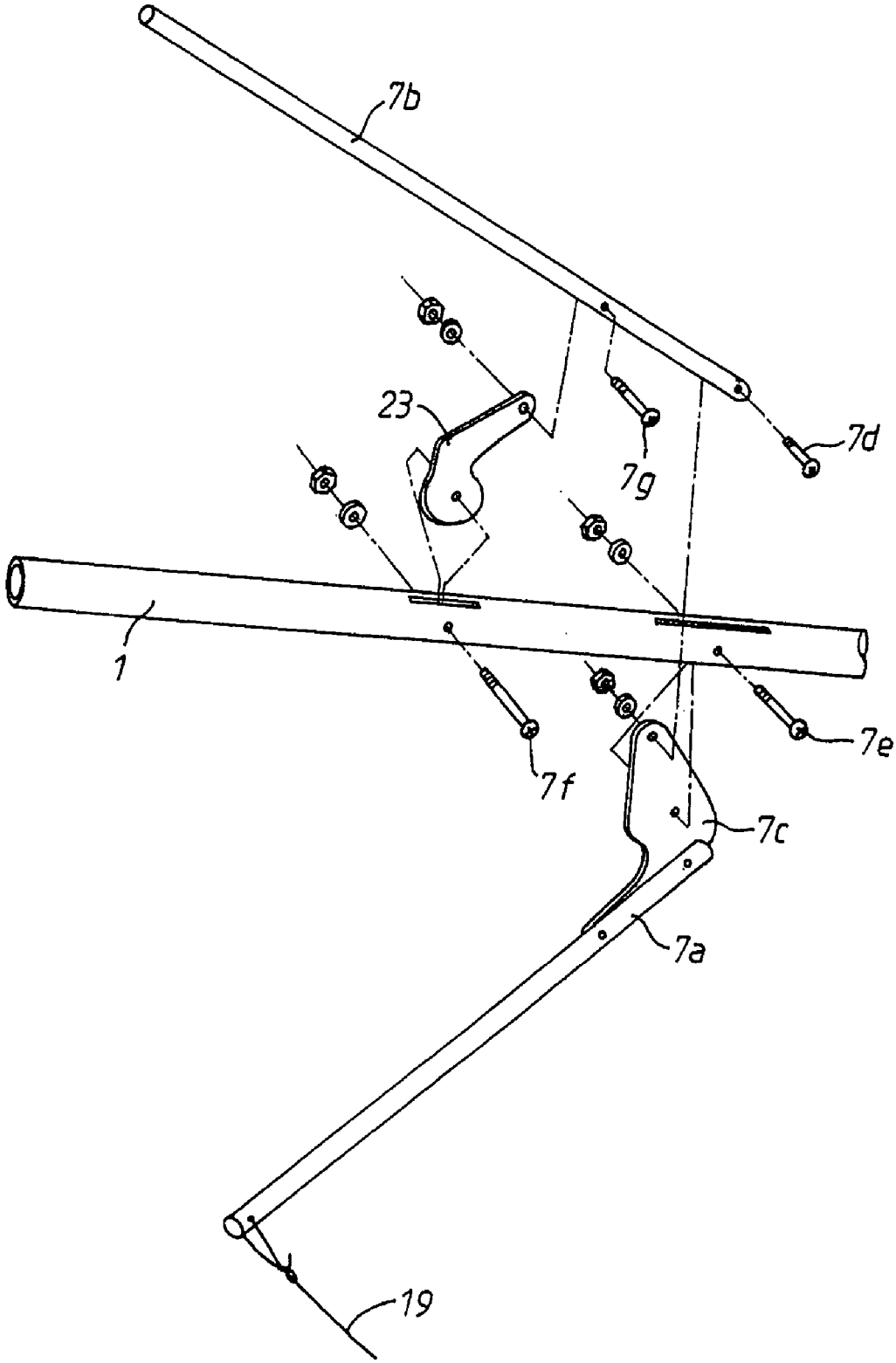
FIG. 14 is a perspective view of an aft section of the sail portion.

In this second embodiment, as shown in FIGS. 13 and 14, the backbone 1 is provided at its aft portion with lower and upper ribs 7*a* and 7*b*. The lower rib 7*a* is in the form of a pipe of small diameter which is connected to a metallic lower rib link plat 7*c* at its one end. The lower rib link plate 7*a* is inserted into a longitudinal slit of backbone 1 and pivoted at its intermediate portion to a bolt 7*e* passed through the backbone 1 and fixed in place by means of a fastening nut. The upper rib 7*b* is pivoted to an upper portion of the lower rib link plate 7*a* projected upward from the longitudinal slit by means of a bolt 7*c*. A metallic ancillary link plate 23 is inserted into another longitudinal slit of the backbone and pivoted to a bolt 7*f* passed through the backbone 1 and fixed in place by means of a fastening nut. The upper rib 7*b* is pivoted at its intermediate portion to an upper portion of the ancillary link plate 23 by means of a bolt 7*g*. A tail-cloth 22 is pitched between the lower and upper ribs 7*a* and 7*b*, and a tail string 19 is connected at its opposite ends to a rear end of lower rib 7*a* and to the distal end of handle 6*b*. When the sail portion A is unfolded, the tail string 19 acts to draw the lower rib 7*a* downward, and the tail-cloth 22 is unfolded in the form of a vertical tail-wing to enhance stability in directional stability of the sailing device. When the sailing device is folded, the tail string 19 is loosen, and the tail-cloth is folded.

As shown in FIG. 13, a fixing piece 24*a* is secured to the central rear portion of sail-cloth 8, and a tension rubber ring 24 is hooked with the fixing piece 24*a* to hang the backbone 1 on the sail-cloth 8. With the rubber ring 24, the sail-cloth 8 is drawn downward to the backbone 1 to enhance vertical stability of the sailing device in the strong wind. When receives a gentle wind, the tension rubber ring 24 is removed from the fixing piece 24*a* to increase a propulsive force. When the ancillary link plate 23 is replaced to increase an angle of the upper rib 7*b*, the vertical stability of the sailing device is obtainable even in the strong wind.

Figure 15:
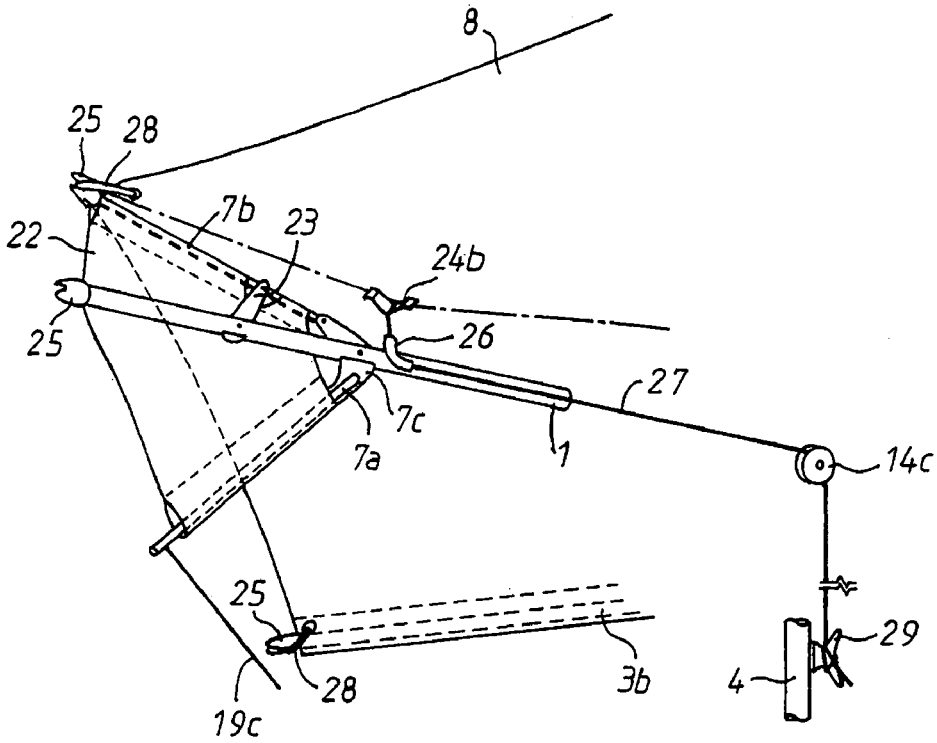
FIG. 15 is a perspective view illustrating a modification of the aft section of the sail portion in the second embodiment.

In a modification shown in FIG. 15, a fixing piece 24*b* is secured to the central rear portion of sail-cloth 8, and a pull-down rope 27 is connected at its one end to the fixing piece 24*b* and extended toward a second pulley 14*c* through a guide pipe 26 under the backbone 1. The pull-down rope 27 further extended through the second pulley 14*c* is connected at its other end to a cleat 29 which is mounted to an intermediate lower portion of strut 4. With provision of the pull-down rope 27, it is able to adjust the pull-down degree of the sail portion A at its aft portion during sailing of the boat for adjustment of the vertical stability and propulsive force of the sailing device.

In the embodiments described above, the rods 5*a*, 5*b* and 5*c* are pivoted at their one ends to the intermediate portions of strut 4 and spars 3*a*, 3*b* and at their other ends to the slider 2 on the backbone 1. With such arrangement of the respective rods, the sailing device can be folded in the form of a single pole. This is useful to facilitate preservation of the sailing device.

What is claimed is:

1. A sailing device suitable for use in a pleasure boat, comprising:

a sail portion composed of a backbone, a pair of left and right spars extending obliquely backward from the fore end of the backbone and a sail-cloth attached at the fore edge thereof to the pair of left and right spars and at the aft end thereof to the aft end of the backbone; and a strut capable of being hinged at the upper end thereof to the fore end of the backbone to be movable between a position extending downward from the fore end of the backbone and a position along the backbone, the lower end of said strut being directly mounted on the boat hull or indirectly attached to the boat hull by support of a user to permit rise and fall movement of the strut, wherein said sail portion has left and right wing sections each provided with a dihedral angle, wherein said left and right spars are connected to each other at their intermediate portions by means of an upper tension rope, and wherein said left and right spars are connected at their intermediate portions to an intermediate portion of said strut by means of left and right tension ropes.

2. A sailing device suitable for use in a pleasure boat, comprising:

a sail portion composed of a backbone, a pair of left and right spars extending obliquely backward from the fore end of the backbone and a sail-cloth attached at the fore edge thereof to the pair of left and right spars and at the aft end thereof to the aft end of the backbone; and a strut capable of being hinged at the upper end thereof to the fore end of the backbone to be movable between a position extending downward from the fore end of the backbone and a position along the backbone, the lower end of said strut being directly mounted on the boat hull or indirectly attached to the boat hull by support of a user to permit rise and fall movement of the strut, wherein said left and right spars are connected at their one ends to the fore end of said backbone for tilt movement, a slider is mounted on an intermediate portion of said backbone for slide movement in a longitudinal direction of said backbone, left and right rods are pivoted at their one ends to each intermediate portion of said spars and at their other ends to said slider, and a lower rod is pivoted at its one end to an intermediate portion of said strut and at its other end to said slider, and wherein said slider is moveable in the longitudinal direction of said backbone to extend said spars obliquely backward from the fore end of said backbone and to fold said spars along said backbone, said slider being engageable with a stopper hook fixed to the fore portion of said backbone when said strut is unfolded downward from the fore end of said backbone and is folded along said backbone.

3. A sailing device suitable for use in a pleasure boat, comprising:

a sail portion composed of a backbone, a pair of left and right spars extending obliquely backward from the fore end of the backbone and a sail-cloth attached at the fore edge thereof to the pair of left and right spars and at the aft end thereof to the aft end of the backbone; and a strut capable of being hinged at the upper end thereof to the fore end of the backbone to be movable between a position extending downward from the fore end of the backbone and a position along the backbone, the lower end of said strut being directly mounted on the boat hull or indirectly attached to the boat hull by support of a user to permit rise and fall movement of the strut, wherein a lateral handle is mounted to an intermediate portion of said strut for operation of the sailing device, and wherein said handle is fixed in a lateral position when it is used and is folded along said strut when it is not used.

4. A sailing device as claimed in claim 2, wherein an unfolding rope connected at its one end to said slider is extended forward along said backbone and extended downward along said strut through a guide pulley mounted to the fore end of said backbone to move said slider forward when a grip connected to its other end is drawn by the user, and wherein a release rope is connected at its one end to said stopper hook to disengage said slider from said stopper hook when a grip connected to its other end is drawn by the user.

5. A sailing device as claimed in claim 2, wherein the central aft portion of said sail-cloth is detachably fastened to said backbone.

6. A sailing device suitable for use in a pleasure boat, comprising:

a sail portion composed of a backbone, a pair of left and right spars extending obliquely backward from the fore end of the backbone and a sail-cloth attached at the fore edge thereof to the pair of left and right spars and at the aft end thereof to the aft end of the backbone; and a strut capable of being hinged at the upper end thereof to the fore end of the backbone to be movable between a position extending downward from the fore end of the backbone and a position along the backbone, the lower end of said strut being directly mounted on the boat hull or indirectly attached to the boat hull by support of a user to permit rise and fall movement of the strut, wherein an upper rib pivoted at its one end to the aft portion of said backbone to be moveable between a first position where it is approached above the aft portion of said backbone and a second position where it is approached to said backbone at its front end and apart from said backbone at its rear end, and wherein said sail-cloth is attached at its aft end portion to the rear end of said upper rib and is detachably fastened at its central aft portion to the front end of said upper rib or said backbone at a position near the front end of said upper rib.

7. A sailing device as claimed in claim 3, wherein an unfolding rope connected at its one end to said slider is extended forward along said backbone and extended downward along said strut through a guide pulley mounted to the fore end of said backbone to move said slider forward when a grip connected to its other end is drawn by the user, and wherein a release rope is connected at its one end to said stopper hook to disengage said slider from said stopper hook when a grip connected to its other end is drawn by the user.

* * * * *